US012495842B2

(12) United States Patent
Guan et al.

(10) Patent No.: US 12,495,842 B2
(45) Date of Patent: Dec. 16, 2025

(54) BATTERY FOR VAPORIZER DEVICE

(71) Applicant: JUUL LABS, INC., San Francisco, CA (US)

(72) Inventors: Jie Guan, Morgan Hill, CA (US); Val Valentine, San Francisco, CA (US); Qingcheng Zeng, San Jose, CA (US)

(73) Assignee: JUUL Labs, Inc., Washington, DC (US)

( * ) Notice: Subject to any disclaimer, the term of this patent is extended or adjusted under 35 U.S.C. 154(b) by 677 days.

(21) Appl. No.: 17/675,960

(22) Filed: Feb. 18, 2022

(65) Prior Publication Data

US 2022/0167683 A1 Jun. 2, 2022

Related U.S. Application Data

(63) Continuation of application No. PCT/US2020/047336, filed on Aug. 21, 2020.

(60) Provisional application No. 62/890,446, filed on Aug. 22, 2019.

(51) Int. Cl.

| | |
|---|---|
| ***A24F 40/00*** | (2020.01) |
| ***A24F 40/10*** | (2020.01) |
| ***A24F 40/42*** | (2020.01) |
| ***A24F 40/48*** | (2020.01) |
| ***A24F 40/90*** | (2020.01) |

(52) U.S. Cl.

CPC ..... *A24F 40/90* (2020.01); *A24F 40/10* (2020.01); *A24F 40/42* (2020.01); *A24F 40/48* (2020.01)

(58) Field of Classification Search

CPC ..... A24F 40/90; A24F 40/10; A24F 40/42; A24F 40/48; A24F 40/05; A24F 40/40

See application file for complete search history.

(56) References Cited

U.S. PATENT DOCUMENTS

| | | | |
|---|---|---|---|
| 9,326,548 | B2 | 5/2016 | Hon |
| 9,351,522 | B2 | 5/2016 | Safari |
| 9,723,877 | B2 | 8/2017 | Wong et al. |
| 9,781,953 | B2 | 10/2017 | Verleur et al. |
| 9,814,262 | B2 | 11/2017 | Peleg et al. |
| 9,943,107 | B2 | 4/2018 | Weigensberg et al. |
| 10,278,382 | B2 | 5/2019 | Wynalda, Jr. |
| 10,300,225 | B2 | 5/2019 | Terry et al. |
| 10,588,353 | B2 | 3/2020 | Hon |
| 10,721,969 | B2 | 7/2020 | Capuano et al. |

(Continued)

FOREIGN PATENT DOCUMENTS

| | | | | |
|---|---|---|---|---|
| CA | 2778786 | A1 * | 5/2011 | ..... A24B 15/16 |
| CA | 3026851 | A1 * | 2/2020 | ..... A24F 40/10 |

(Continued)

OTHER PUBLICATIONS

PCT/US2020/047336, Aug. 21, 2020, WO 2021/035118.

*Primary Examiner* — Renee S Luebke

(74) *Attorney, Agent, or Firm* — Mintz Levin Cohn Ferris Glovsky and Popeo, P.C.

(57) ABSTRACT

A vaporizer that includes a metal-air battery, in particular a zinc-air battery is described herein. The metal-air battery can have increased power output relative to conventional batteries. Various embodiments of the vaporizer are described that include one or more features for low environmental impact, disposability, and increased power output. Related systems, methods, and articles of manufacture are also described.

20 Claims, 2 Drawing Sheets

(56) References Cited

U.S. PATENT DOCUMENTS

| | | | |
|---|---|---|---|
| 10,893,704 | B2 | 1/2021 | Verleur et al. |
| 11,083,229 | B2 | 8/2021 | Holtz et al. |
| 2008/0056691 | A1 | 3/2008 | Wingo et al. |
| 2010/0065653 | A1 | 3/2010 | Wingo et al. |
| 2011/0177401 | A1 | 7/2011 | Crowther et al. |
| 2013/0284192 | A1 | 10/2013 | Peleg et al. |
| 2013/0319439 | A1 | 12/2013 | Gorelick et al. |
| 2013/0340775 | A1 | 12/2013 | Juster et al. |
| 2014/0034071 | A1 | 2/2014 | Levitz et al. |
| 2014/0230835 | A1 | 8/2014 | Saliman |
| 2014/0276536 | A1 | 9/2014 | Estes |
| 2015/0027472 | A1 | 1/2015 | Amir |
| 2015/0128973 | A1 | 5/2015 | Li et al. |
| 2015/0342256 | A1 | 12/2015 | Chen |
| 2015/0366266 | A1 | 12/2015 | Chen |
| 2016/0120226 | A1 | 5/2016 | Rado |
| 2016/0183596 | A1 | 6/2016 | Rado |
| 2016/0309785 | A1 | 10/2016 | Holtz |
| 2017/0251726 | A1 | 9/2017 | Nielsen |
| 2017/0251727 | A1 | 9/2017 | Nielsen |
| 2020/0038601 | A1 | 2/2020 | Hepworth et al. |
| 2021/0401061 | A1 | 12/2021 | Davis et al. |

FOREIGN PATENT DOCUMENTS

| | | | | | |
|---|---|---|---|---|---|
| CN | 1342336 | A | * | 3/2002 | ..... H01M 6/50 |
| CN | 201781984 | U | | 4/2011 | |
| CN | 203969214 | U | | 12/2014 | |
| CN | 104621717 | B | | 5/2015 | |
| CN | 105050434 | A | | 11/2015 | |
| CN | 204763429 | U | | 11/2015 | |
| CN | 205069815 | U | | 3/2016 | |
| CN | 108136141 | A | * | 6/2018 | ..... A24F 47/00 |
| EP | 0079523 | A1 | | 5/1983 | |
| EP | 3000245 | B1 | | 3/2016 | |
| EP | 3434121 | B1 | | 1/2019 | |
| EP | 3487333 | B1 | | 5/2019 | |
| EP | 3491945 | B1 | | 6/2019 | |
| EP | 3871468 | B1 | | 9/2021 | |
| GB | 2592138 | B | | 8/2021 | |
| IN | 646DELNP2013 | A | | 10/2014 | |
| JP | 5588689 | B2 | * | 9/2014 | |
| KR | 101554435 | B1 | | 9/2015 | |
| WO | WO-9425991 | A2 | | 11/1994 | |
| WO | WO-2011052440 | A1 | | 5/2011 | |
| WO | WO-2012026963 | A2 | | 3/2012 | |
| WO | WO-2013110210 | A1 | | 8/2013 | |
| WO | WO-2015035510 | A1 | | 3/2015 | |
| WO | WO-2015148649 | A2 | | 10/2015 | |
| WO | WO-2016150019 | A1 | | 9/2016 | |
| WO | WO-2016178098 | A2 | | 11/2016 | |
| WO | WO-2019173923 | A1 | | 9/2019 | |

* cited by examiner

BATTERY FOR VAPORIZER DEVICE

CROSS REFERENCE TO RELATED APPLICATIONS

This application is a continuation application, filed under 35 U.S.C. § 120, of PCT International Patent Application No. PCT/US20/47336 with an International Filing Date of Aug. 21, 2020, and entitled "BATTERY FOR VAPORIZER DEVICE," which claims priority to and the benefit of U.S. Provisional Application No. 62/890,446, filed Aug. 22, 2019, and entitled "Vaporizer Device," each of which is hereby incorporated by reference in its entirety and for all purposes.

TECHNICAL FIELD

The subject matter described herein relates to vaporizer devices, including vaporizer devices with metal-air batteries.

BACKGROUND

Vaporizer devices, which can also be referred to as vaporizers, electronic vaporizer devices or e-vaporizer devices, can be used for delivery of an aerosol (or "vapor") containing one or more active ingredients by inhalation of the aerosol by a user of the vaporizing device. For example, electronic nicotine delivery systems (ENDS) include a class of vaporizer devices that are battery powered and that may be used to simulate the experience of smoking, but without burning of tobacco or other substances.

In use of a vaporizer device, the user inhales an aerosol, commonly called vapor, which may be generated by a heating element that vaporizes (e.g., causing a liquid or solid to at least partially transition to the gas phase) a vaporizable material, which may be liquid, a solution, a solid, a wax, or any other form as may be compatible with use of a specific vaporizer device. The vaporizable material used with a vaporizer can be provided within a cartridge (e.g., a separable part of the vaporizer that contains the vaporizable material in a reservoir) that includes a mouthpiece (e.g., for inhalation by a user).

To receive the inhalable aerosol generated by a vaporizer device, a user may, in certain examples, activate the vaporizer device by taking a puff, by pressing a button, or by some other approach. A puff, as the term is generally used (and also used herein), refers to inhalation by the user in a manner that causes a volume of air to be drawn into the vaporizer device such that the inhalable aerosol is generated by a combination of vaporized vaporizable material with the air.

A typical approach by which a vaporizer device generates an inhalable aerosol from a vaporizable material involves heating the vaporizable material in a vaporization chamber (or a heater chamber) to cause the vaporizable material to be converted to the gas (or vapor) phase. A vaporization chamber generally refers to an area or volume in the vaporizer device within which a heat source (e.g., conductive, convective, and/or radiative) causes heating of a vaporizable material to produce a mixture of air and vaporized vaporizable material to form a vapor for inhalation by a user of the vaporizer.

Currently available vaporizers often use a power source such as a lithium-ion battery. Lithium-ion batteries are useful due to their power density and high discharge rates. Lithium-ion batteries are not suited for disposal systems due to the materials used and the high cost to produce. Recycling lithium-ion batteries is difficult and requires high heat and harsh chemicals to recover the cathode materials. As such, improved vaporization devices and/or vaporization cartridges that improve upon or overcome these issues is desired.

The term vaporizer device, as used herein consistent with the current subject matter, generally refers to portable, self-contained, devices that are convenient for personal use. Typically, such devices are controlled by one or more switches, buttons, touch sensitive devices, or other user input functionality or the like (which can be referred to generally as controls) on the vaporizer, although a number of devices that may wirelessly communicate with an external controller (e.g., a smartphone, a smart watch, other wearable electronic devices, etc.) have recently become available. Control, in this context, refers generally to an ability to influence one or more of a variety of operating parameters, which may include without limitation any of causing the heater to be turned on and/or off, adjusting a minimum and/or maximum temperature to which the heater is heated during operation, various games or other interactive features that a user might access on a device, and/or other operations.

Various vaporizable materials having a variety of contents and proportions of such contents can be contained in the cartridge. Some vaporizable materials, for example, may have a smaller percentage of active ingredients per total volume of vaporizable material, such as due to regulations requiring certain active ingredient percentages. As a result, a user may need to vaporize a large amount of vaporizable material (e.g., compared to the overall volume of vaporizable material that can be stored in a cartridge) to achieve a desired effect.

SUMMARY

In certain aspects of the current subject matter, challenges associated with adequate power supply in a disposable vaporizer device may be addressed by inclusion of one or more of the features described herein or comparable/equivalent approaches as would be understood by one of ordinary skill in the art. Aspects of the current subject matter relate to methods and systems related to a power supply of a vaporizer device.

In an aspect, a vaporizer body is provided. The vaporizer body includes a first metal-air battery, an air channel disposed in the vaporizer body, the air channel configured to provide air to the first metal-air battery, and an air pump, attached to the vaporizer body proximate the air channel and configured to selectively provide air through the air channel to the first metal-air battery.

In another, interrelated aspect, a vaporizer body is provided. The vaporizer body includes a first metal-air battery, an air channel disposed and configured to provide air to the first metal-air battery, and a selector valve, wherein the selector valve is disposed and configured to selectively pass air through the air channel to the metal-air battery.

In another, interrelated aspect, a vaporizer is provided. The vaporizer includes a vaporizer body. The vaporizer body includes a first metal-air battery, an air channel configured to provide air to the first metal-air battery, and an air pump, wherein the air pump is configured to selectively blow air through the air channel to the first metal-air battery, and a separable cartridge.

In another, interrelated aspect, a vaporizer is provided. The vaporizer includes a vaporizer body. The vaporizer body includes a first metal-air battery, an air channel configured to provide air to the first metal-air battery, and a selector valve, wherein the selector valve is configured to selectively pass air through the air channel to the first metal-air battery, and a separable cartridge.

In another, interrelated aspect, a vaporizer is provided. The vaporizer includes a vaporizer body. The vaporizer body includes a first metal-air battery, an air channel disposed in the vaporizer body, the air channel configured to provide air to the first metal-air battery, and an air pump, attached to the vaporizer body proximate the air channel and configured to selectively provide air through the air channel to the first metal-air battery.

In another, interrelated aspect, a vaporizer body is provided. The vaporizer body includes a first metal-air battery, an air channel disposed in the vaporizer body, the air channel configured to provide air to the first metal-air battery, and an air pump, attached to the vaporizer body proximate the air channel and configured to selectively provide air through the air channel to the first metal-air battery.

In some variations, one or more of the following features may optionally be included in any feasible combination.

In embodiments, the vaporizer body includes a cartridge receptacle configured to receive a cartridge including a vaporizable material. In embodiments, the vaporizer body includes a cartridge receptacle configured to insertably receive a cartridge containing a vaporizable material. In embodiments, the vaporizer body includes a storage compartment configured to receive a vaporizable material. In embodiments, the vaporizer body includes a cartridge coupler configured to couple a cartridge including a vaporizable material. In embodiments, the air channel is configured to provide air to a cathode of the first metal-air battery. In embodiments, the air pump is configured to selectively provide air through the air channel to a cathode of the first metal-air battery. In embodiments, the vaporizer body has a first end and a second end, wherein the first end is opposite to the second end, and wherein the first end is free of electrical contacts. In embodiments, the cartridge receptacle is disposed at the second end. In embodiments, a base of the cartridge receptacle includes one or more electrical contacts configured to transmit an electrical power to the cartridge. In embodiments, the air channel extends from the base of the cartridge receptacle. In embodiments, the air channel extends to the first end of the vaporizer body. In embodiments, the air channel extends along a length of a cathode of the first metal-air battery.

In embodiments, an anode of the first metal-air battery includes a metallic powder. In embodiments, an anode of the first metal-air battery includes a metal alloy. In embodiments, a cathode of the first metal-air battery includes a porous carbon. In embodiments, a cathode of the first metal-air battery includes a porous activated carbon. In embodiments, an electrolyte of the first metal-air battery includes potassium hydroxide. In embodiments, an electrolyte of the first metal-air battery includes an additive. In embodiments, the first metal-air battery further includes a selectively permeable membrane disposed on a cathode of the first metal-air battery. In embodiments, the first metal-air battery further includes a selectively permeable membrane forming a portion of the air channel. In embodiments, the selectively permeable membrane is permeable to oxygen and/or air. In embodiments, the selectively permeable membrane is impermeable to water and/or carbon dioxide. In embodiments, the air pump includes a flexible bladder. In embodiments, the air pump includes a pressurizable tank. In embodiments, the air pump includes a mechanical pump. In embodiments, the air pump includes an electrical pump.

In embodiments, the vaporizer body further includes a second metal-air battery. In embodiments, the air channel is disposed between a first cathode of the first metal-air battery and a second cathode of the second metal-air battery. In embodiments, the vaporizer body further includes a selectively permeable membrane, wherein the selectively permeable membrane is disposed between the air channel, and at least one of the first cathode and the second cathode. In embodiments, the vaporizable material includes a nicotine formulation.

In embodiments, a base of the cartridge receptacle includes one or more electrical contacts configured to transmit, to the cartridge, an electrical power. In embodiments, the vaporizer further includes a selectively permeable membrane, wherein the selectively permeable membrane is disposed between the air channel, and at least one of the first cathode and the second cathode. In embodiments, the vaporizer includes a mouthpiece disposed at the second end. In embodiments, the air channel extends from the base of the storage compartment. In embodiments, the cartridge coupler is disposed at the second end. In embodiments, a base of the cartridge coupler includes one or more electrical contacts configured to transmit an electrical power to the cartridge. In embodiments, the air channel extends from the base of the cartridge coupler.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Implementations of the current subject matter include devices relating to vaporizing of one or more materials for inhalation by a user. The term "vaporizer" is used generically in the following description to refer to a vaporizer device. Examples of vaporizers consistent with implementations of the current subject matter include electronic vaporizers or the like. Such vaporizers are generally portable, hand-held devices that heat a vaporizable material to provide an inhalable dose of the material.

The vaporizable material used with a vaporizer may optionally be provided within a cartridge (e.g., a part of the vaporizer that contains the vaporizable material in a reservoir or other container and that can be refillable when empty or disposable in favor of a new cartridge containing additional vaporizable material of a same or different type). A vaporizer may be a cartridge-using vaporizer, a cartridge-less vaporizer, or a multi-use vaporizer capable of use with or without a cartridge. For example, a multi-use vaporizer may include a heating chamber (e.g., an oven) configured to receive a vaporizable material directly in the heating chamber and also to receive a cartridge or other replaceable device having a reservoir, a volume, or the like for at least partially containing a usable amount of vaporizable material.

In various implementations, a vaporizer may be configured for use with liquid vaporizable material (e.g., a carrier solution in which an active and/or inactive ingredient(s) are suspended or held in solution or a neat liquid form of the vaporizable material itself) or a solid vaporizable material. A solid vaporizable material may include a plant material that emits some part of the plant material as the vaporizable material (e.g., such that some part of the plant material remains as waste after the vaporizable material is emitted for inhalation by a user) or optionally can be a solid form of the vaporizable material itself (e.g., a "wax") such that all of the solid material can eventually be vaporized for inhalation. A liquid vaporizable material can likewise be capable of being completely vaporized or can include some part of the liquid material that remains after all of the material suitable for inhalation has been consumed. In some examples, the vaporizable material includes a nicotine formulation.

Figure 1A:
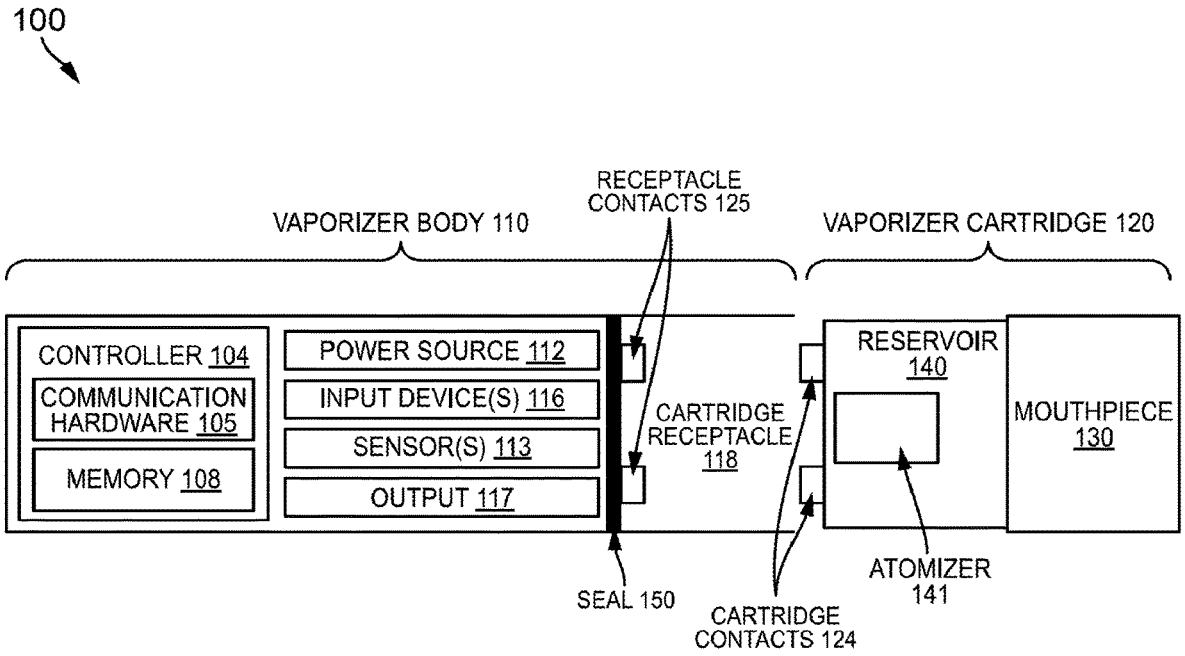
FIG. 1A illustrates a block diagram of a vaporizer consistent with implementations of the current subject matter.

Referring to the block diagram of FIG. 1A, a vaporizer 100 typically includes a power source 112 (such as a battery), and a controller 104 (e.g., a processor, circuitry, etc. capable of executing logic) for controlling delivery of heat to an atomizer 141 to cause a vaporizable material to be converted from a condensed form (e.g., a solid, a liquid, a solution, a suspension, a part of an at least partially unprocessed plant material, etc.) to the gas phase. The controller 104 may be part of one or more printed circuit boards (PCBs) consistent with certain implementations of the current subject matter.

After conversion of the vaporizable material to the gas phase, and depending on the type of vaporizer, the physical and chemical properties of the vaporizable material, and/or other factors, at least some of the gas-phase vaporizable material may condense to form particulate matter in at least a partial local equilibrium with the gas phase as part of an aerosol, which can form some or all of an inhalable dose provided by the vaporizer 100 for a given puff or draw on the vaporizer. It will be understood that the interplay between gas and condensed phases in an aerosol generated by a vaporizer can be complex and dynamic, as factors such as ambient temperature, relative humidity, chemistry, flow conditions in airflow paths (both inside the vaporizer and in the airways of a human or other animal), mixing of the gas-phase or aerosol-phase vaporizable material with other air streams, etc. may affect one or more physical parameters of an aerosol. In some vaporizers, and particularly for vaporizers for delivery of more volatile vaporizable materials, the inhalable dose may exist predominantly in the gas phase (i.e., formation of condensed phase particles may be very limited).

Vaporizers for use with liquid vaporizable materials (e.g., neat liquids, suspensions, solutions, mixtures, etc.) typically include an atomizer 141 in which a wicking element (also referred to herein as a wick (not shown in FIG. 1A), which can include any material capable of causing fluid motion by capillary pressure) conveys an amount of a liquid vaporizable material to a part of the atomizer that includes a heating element (also not shown in FIG. 1A). The wicking element is generally configured to draw liquid vaporizable material from a reservoir configured to contain (and that may in use contain) the liquid vaporizable material such that the liquid vaporizable material may be vaporized by heat delivered from a heating element. The wicking element may also optionally allow air to enter the reservoir to replace the volume of liquid removed. In other words, capillary action pulls liquid vaporizable material into the wick for vaporization by the heating element (described below), and air may, in some implementations of the current subject matter, return to the reservoir through the wick to at least partially equalize pressure in the reservoir. Other approaches to allowing air back into the reservoir to equalize pressure are also within the scope of the current subject matter.

The heating element can be or include one or more of a conductive heater, a radiative heater, and a convective heater. One type of heating element is a resistive heating element, which can be constructed of or at least include a material (e.g., a metal or alloy, for example a nickel-chromium alloy, or a non-metallic resistor) configured to dissipate electrical power in the form of heat when electrical current is passed through one or more resistive segments of the heating element. In some implementations of the current subject matter, an atomizer can include a heating element that includes a resistive coil or other heating element wrapped around, positioned within, integrated into a bulk shape of, pressed into thermal contact with, or otherwise arranged to deliver heat to a wicking element to cause a liquid vaporizable material drawn by the wicking element from a reservoir to be vaporized for subsequent inhalation by a user in a gas and/or a condensed (e.g., aerosol particles or droplets) phase. Other wicking element, heating element, and/or atomizer assembly configurations are also possible, as discussed further below.

Certain vaporizers may also or alternatively be configured to create an inhalable dose of gas-phase and/or aerosol-phase vaporizable material via heating of a non-liquid vaporizable material, such as for example a solid-phase vaporizable material (e.g., a wax or the like) or plant material (e.g., tobacco leaves and/or parts of tobacco leaves) containing the vaporizable material. In such vaporizers, a resistive heating element may be part of or otherwise incorporated into or in thermal contact with the walls of an oven or other heating chamber into which the non-liquid vaporizable material is placed. Alternatively, a resistive heating element or elements may be used to heat air passing through or past the non-liquid vaporizable material to cause convective heating of the non-liquid vaporizable material. In still other examples, a resistive heating element or elements may be disposed in intimate contact with plant material such that direct conductive heating of the plant material occurs from within a mass of the plant material (e.g., as opposed to only by conduction inward form walls of an oven).

The heating element may be activated (e.g., a controller, which is optionally part of a vaporizer body as discussed below, may cause current to pass from the power source through a circuit including the resistive heating element, which is optionally part of a vaporizer cartridge as discussed below), in association with a user puffing (e.g., drawing, inhaling, etc.) on a mouthpiece 130 of the vaporizer to cause air to flow from an air inlet, along an airflow path that passes an atomizer (e.g., wicking element and heating element), optionally through one or more condensation areas or chambers, to an air outlet in the mouthpiece. Incoming air passing along the airflow path passes over, through, etc. the atomizer, where gas phase vaporizable material is entrained into the air. As noted above, the entrained gas-phase vaporizable material may condense as it passes through the remainder of the airflow path such that an inhalable dose of the vaporizable material in an aerosol form can be delivered from the air outlet (e.g., in a mouthpiece 130 for inhalation by a user).

Activation of the heating element may be caused by automatic detection of the puff based on one or more of signals generated by one or more sensors 113, such as for example a pressure sensor or sensors disposed to detect pressure along the airflow path relative to ambient pressure (or optionally to measure changes in absolute pressure), one or more motion sensors of the vaporizer, one or more flow sensors of the vaporizer, a capacitive lip sensor of the vaporizer; in response to detection of interaction of a user with one or more input devices 116 (e.g., buttons or other tactile control devices of the vaporizer 100), receipt of signals from a computing device in communication with the vaporizer; and/or via other approaches for determining that a puff is occurring or imminent.

As alluded to in the previous paragraph, a vaporizer consistent with implementations of the current subject matter may be configured to connect (e.g., wirelessly or via a wired connection) to a computing device (or optionally two or more devices) in communication with the vaporizer. To this end, the controller 104 may include communication hardware 105. The controller 104 may also include a memory 108. A computing device can be a component of a vaporizer system that also includes the vaporizer 100, and can include its own communication hardware, which can establish a wireless communication channel with the communication hardware 105 of the vaporizer 100. For example, a computing device used as part of a vaporizer system may include a general-purpose computing device (e.g., a smartphone, a tablet, a personal computer, some other portable device such as a smartwatch, or the like) that executes software to produce a user interface for enabling a user of the device to interact with a vaporizer. In other implementations of the current subject matter, such a device used as part of a vaporizer system can be a dedicated piece of hardware such as a remote control or other wireless or wired device having one or more physical or soft (e.g., configurable on a screen or other display device and selectable via user interaction with a touch-sensitive screen or some other input device like a mouse, pointer, trackball, cursor buttons, or the like) interface controls. The vaporizer can also include one or more output 117 features or devices for providing information to the user.

A computing device that is part of a vaporizer system as defined above can be used for any of one or more functions, such as controlling dosing (e.g., dose monitoring, dose setting, dose limiting, user tracking, etc.), controlling sessioning (e.g., session monitoring, session setting, session limiting, user tracking, etc.), controlling nicotine delivery (e.g., switching between nicotine and non-nicotine vaporizable material, adjusting an amount of nicotine delivered, etc.), obtaining locational information (e.g., location of other users, retailer/commercial venue locations, vaping locations, relative or absolute location of the vaporizer itself, etc.), vaporizer personalization (e.g., naming the vaporizer, locking/password protecting the vaporizer, adjusting one or more parental controls, associating the vaporizer with a user group, registering the vaporizer with a manufacturer or warranty maintenance organization, etc.), engaging in social activities (e.g., games, social media communications, interacting with one or more groups, etc.) with other users, or the like. The terms "sessioning", "session", "vaporizer session," or "vapor session," are used generically to refer to a period devoted to the use of the vaporizer. The period can include a time period, a number of doses, an amount of vaporizable material, and/or the like.

In the example in which a computing device provides signals related to activation of the resistive heating element, or in other examples of coupling of a computing device with a vaporizer for implementation of various control or other functions, the computing device executes one or more computer instructions sets to provide a user interface and underlying data handling. In one example, detection by the computing device of user interaction with one or more user interface elements can cause the computing device to signal the vaporizer 100 to activate the heating element, either to a full operating temperature for creation of an inhalable dose of vapor/aerosol. Other functions of the vaporizer may be controlled by interaction of a user with a user interface on a computing device in communication with the vaporizer.

The temperature of a resistive heating element of a vaporizer may depend on a number of factors, including an amount of electrical power delivered to the resistive heating element and/or a duty cycle at which the electrical power is delivered, conductive heat transfer to other parts of the electronic vaporizer and/or to the environment, latent heat losses due to vaporization of a vaporizable material from the wicking element and/or the atomizer as a whole, and convective heat losses due to airflow (e.g., air moving across the heating element or the atomizer as a whole when a user inhales on the electronic vaporizer). As noted above, to reliably activate the heating element or heat the heating element to a desired temperature, a vaporizer may, in some implementations of the current subject matter, make use of signals from a pressure sensor to determine when a user is inhaling. The pressure sensor can be positioned in the airflow path and/or can be connected (e.g., by a passageway or other path) to an airflow path connecting an inlet for air to enter the device and an outlet via which the user inhales the resulting vapor and/or aerosol such that the pressure sensor experiences pressure changes concurrently with air passing through the vaporizer device from the air inlet to the air outlet. In some implementations of the current subject matter, the heating element may be activated in association with a user's puff, for example by automatic detection of the puff, for example by the pressure sensor detecting a pressure change in the airflow path.

Typically, the pressure sensor (as well as any other sensors 113) can be positioned on or coupled (e.g., electrically or electronically connected, either physically or via a wireless connection) to the controller 104 (e.g., a printed circuit board assembly or other type of circuit board). To take measurements accurately and maintain durability of the vaporizer, it can be beneficial to provide a resilient seal 150 to separate an airflow path from other parts of the vaporizer. The seal 150, which can be a gasket, may be configured to at least partially surround the pressure sensor such that connections of the pressure sensor to internal circuitry of the vaporizer are separated from a part of the pressure sensor exposed to the airflow path. In an example of a cartridge-based vaporizer, the seal 150 may also separate parts of one or more electrical connections between a vaporizer body 110 and a vaporizer cartridge 120. Such arrangements of a seal 150 in a vaporizer 100 can be helpful in mitigating against potentially disruptive impacts on vaporizer components resulting from interactions with environmental factors such as water in the vapor or liquid phases, other fluids such as the vaporizable material, etc. and/or to reduce escape of air from the designed airflow path in the vaporizer. Unwanted air, liquid or other fluid passing and/or contacting circuitry of the vaporizer can cause various unwanted effects, such as altered pressure readings, and/or can result in the buildup of unwanted material, such as moisture, the vaporizable material, etc. in parts of the vaporizer where they may result in poor pressure signal, degradation of the pressure sensor or other components, and/or a shorter life of the vaporizer. Leaks in the seal 150 can also result in a user inhaling air that has passed over parts of the vaporizer device containing or constructed of materials that may not be desirable to be inhaled.

A general class of vaporizers that have recently gained popularity includes a vaporizer body 110 that includes a controller 104, a power source 112 (e.g., battery), one more sensors 113, charging contacts, a seal 150, and a cartridge receptacle 118 configured to receive a vaporizer cartridge 120 for coupling with the vaporizer body through one or more of a variety of attachment structures. In some examples, vaporizer cartridge 120 includes a reservoir 140 for containing a liquid vaporizable material and a mouthpiece 130 for delivering an inhalable dose to a user. The vaporizer cartridge can include an atomizer 141 having a wicking element and a heating element, or alternatively, one or both of the wicking element and the heating element can be part of the vaporizer body 110. In implementations in which any part of the atomizer 141 (e.g., heating element and/or wicking element) is part of the vaporizer body 110, the vaporizer can be configured to supply liquid vaporizable material from a reservoir 140 in the vaporizer cartridge 120 to the atomizer 141 part(s) included in the vaporizer body.

Cartridge-based configurations for vaporizers that generate an inhalable dose of a non-liquid vaporizable material via heating of a non-liquid vaporizable material are also within the scope of the current subject matter. For example, a vaporizer cartridge may include a mass of a plant material that is processed and formed to have direct contact with parts of one or more resistive heating elements, and such a vaporizer cartridge may be configured to be coupled mechanically and electrically to a vaporizer body the includes a processor, a power source, and electrical contacts for connecting to corresponding cartridge contacts for completing a circuit with the one or more resistive heating elements.

In vaporizers in which the power source 112 is part of a vaporizer body 110 and a heating element is disposed in a vaporizer cartridge 120 configured to couple with the vaporizer body 110, the vaporizer 100 may include electrical connection features (e.g., means for completing a circuit) for completing a circuit that includes the controller 104 (e.g., a printed circuit board, a microcontroller, or the like), the power source, and the heating element. These features may include at least two contacts on a bottom surface of the vaporizer cartridge 120 (referred to herein as cartridge contacts 124) and at least two contacts disposed near a base of the cartridge receptacle (referred to herein as receptacle contacts 125) of the vaporizer 100 such that the cartridge contacts 124 and the receptacle contacts 125 make electrical connections when the vaporizer cartridge 120 is inserted into and coupled with the cartridge receptacle 118. The circuit completed by these electrical connections can allow delivery of electrical current to the resistive heating element and may further be used for additional functions, such as for example for measuring a resistance of the resistive heating element for use in determining and/or controlling a temperature of the resistive heating element based on a thermal coefficient of resistivity of the resistive heating element, for identifying a cartridge based on one or more electrical characteristics of a resistive heating element or the other circuitry of the vaporizer cartridge, etc.

In some examples of the current subject matter, the at least two cartridge contacts 124 and the at least two receptacle contacts 125 can be configured to electrically connect in either of at least two orientations. In other words, one or more circuits necessary for operation of the vaporizer can be completed by insertion of a vaporizer cartridge 120 in the cartridge receptacle 118 in a first rotational orientation (around an axis along which the end of the vaporizer cartridge having the cartridge is inserted into the cartridge receptacle 118 of the vaporizer body 110) such that a first cartridge contact of the at least two cartridge contacts 124 is electrically connected to a first receptacle contact of the at least two receptacle contacts 125 and a second cartridge contact of the at least two cartridge contacts 124 is electrically connected to a second receptacle contact of the at least two receptacle contacts 125. Furthermore, the one or more circuits necessary for operation of the vaporizer can be completed by insertion of a vaporizer cartridge 120 in the cartridge receptacle 118 in a second rotational orientation such that the first cartridge contact of the at least two cartridge contacts 124 is electrically connected to the second receptacle contact of the at least two receptacle contacts 125 and the second cartridge contact of the at least two cartridge contacts 124 is electrically connected to the first receptacle contact of the at least two receptacle contacts 125. This feature of a vaporizer cartridge 120 being reversible insertable into a cartridge receptacle 118 of the vaporizer body 110 is described further below.

In one example of an attachment structure for coupling a vaporizer cartridge 120 to a vaporizer body 110, the vaporizer body 110 includes a detent (e.g., a dimple, protrusion, etc.) protruding inwardly from an inner surface the cartridge receptacle 118. One or more exterior surfaces of the vaporizer cartridge 120 can include corresponding recesses (not shown in FIG. 1A) that can fit and/or otherwise snap over such detents when an end of the vaporizer cartridge 120 inserted into the cartridge receptacle 118 on the vaporizer body 110. When the vaporizer cartridge 120 and the vaporizer body 110 are coupled (e.g., by insertion of an end of the vaporizer cartridge 120 into the cartridge receptacle 118 of the vaporizer body 110), the detent into the vaporizer body 110 may fit within and/or otherwise be held within the recesses of the vaporizer cartridge 120 to hold the vaporizer cartridge 120 in place when assembled. Such a detent-recess assembly can provide enough support to hold the vaporizer cartridge 120 in place to ensure good contact between the at least two cartridge contacts 124 and the at least two receptacle contacts 125, while allowing release of the vaporizer cartridge 120 from the vaporizer body 110 when a user pulls with reasonable force on the vaporizer cartridge 120 to disengage the vaporizer cartridge 120 from the cartridge receptacle 118.

Further to the discussion above about the electrical connections between a vaporizer cartridge 120 and a vaporizer body 110 being reversible such that at least two rotational orientations of the vaporizer cartridge 120 in the cartridge receptacle 118 are possible, in some vaporizers the shape of the vaporizer cartridge 120, or at least a shape of the end of the vaporizer cartridge 120 that is configured for insertion into the cartridge receptacle 118 may have rotational symmetry of at least order two. In other words, the vaporizer cartridge 120 or at least the insertable end of the vaporizer cartridge 120 may be symmetric upon a rotation of 180° around an axis along which the vaporizer cartridge 120 is inserted into the cartridge receptacle 118. In such a configuration, the circuitry of the vaporizer may support identical operation regardless of which symmetrical orientation of the vaporizer cartridge 120 occurs.

In some examples, the vaporizer cartridge 120, or at least an end of the vaporizer cartridge 120 configured for insertion in the cartridge receptacle 118 may have a non-circular cross section transverse to the axis along which the vaporizer cartridge 120 is inserted into the cartridge receptacle 118. For example, the non-circular cross section may be approximately rectangular, approximately elliptical (e.g., have an approximately oval shape), non-rectangular but with two sets of parallel or approximately parallel opposing sides (e.g., having a parallelogram-like shape), or other shapes having rotational symmetry of at least order two. In this context, approximately having a shape indicates that a basic likeness to the described shape is apparent, but that sides of the shape in question need not be completely linear, and vertices need not be completely sharp. Rounding of both or either of edges or vertices of the cross-sectional shape is contemplated in the description of any non-circular cross section referred to herein.

The at least two cartridge contacts 124 and the at least two receptacle contacts 125 can take various forms. For example, one or both sets of contacts may include conductive pins, tabs, posts, receiving holes for pins or posts, or the like. Some types of contacts may include springs or other urging features to cause better physical and electrical contact between the contacts on the vaporizer cartridge 120 and the vaporizer body 110. The electrical contacts may optionally be gold-plated, and/or can include other materials.

Figure 1B:
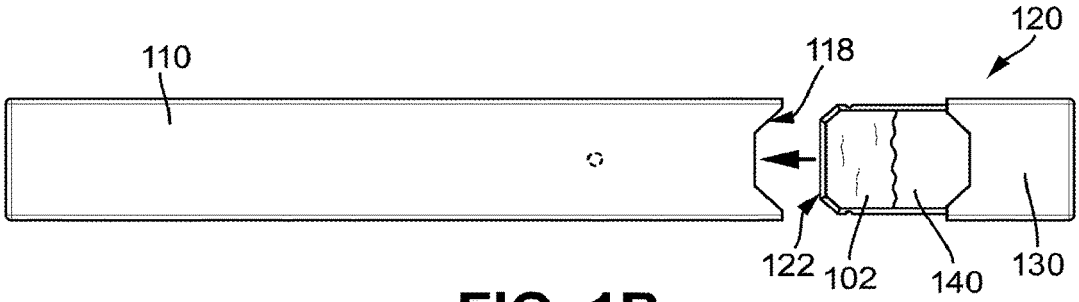
FIG. 1B illustrates a top view of an embodiment of the vaporizer of FIG. 1A showing a cartridge separated from a vaporizer body.

FIG. 1B illustrates an embodiment of the vaporizer body 110 having a first end and a second end, with a cartridge receptacle 118 at the second end into which the vaporizer cartridge 120 may be releasably inserted. The first end may be free of electrical contacts. FIG. 1B shows a top view of the vaporization device 100 illustrating the cartridge being positioned for insertion into the second end of the vaporizer body 110. When a user puffs on the vaporization device 100, air may pass between an outer surface of the vaporizer cartridge 120 and an inner surface of a cartridge receptacle 118 on the vaporizer body 110. Air can then be drawn into an insertable end 122 of the cartridge, through the vaporization chamber that includes or contains the heating element and wick, and out through an outlet of the mouthpiece 130 for delivery of the inhalable aerosol to a user. The reservoir 140 of the vaporizer cartridge 120 may be formed in whole or in part from translucent material such that a level of vaporizable material 102 is visible along the vaporizer cartridge 120.

Figure 2:
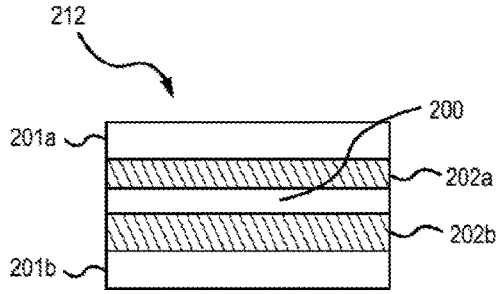
FIG. 2 illustrates a cross-sectional diagram of a metal-air battery.

FIG. 2 illustrates a cross-sectional view of a metal-air battery 212. The metal-air battery 212 may be a zinc-air battery, a lithium-air battery, a sodium-air battery, a potassium-air battery, a magnesium-air battery, a calcium-air battery, an aluminum-air battery, an iron-air battery, a silicon-air battery, and/or the like. In some examples, the metal-air battery 212 is a disposable battery. In some implementations, a vaporizer 100 may include at least one metal-air battery 212 comprising one or more metal-air battery cell(s). Referring to the metal-air battery 212 of FIG. 2, a zinc anode 200 may be at least partially disposed between at least two layers of electrolyte solution 202*a,b*. The zinc anode 200 may consist of powdered zinc, or a zinc alloy. The electrolyte solution 202*a,b* may be a gel, paste, or liquid, and may comprise electrolytes such as potassium hydroxide or the like. The layers of electrolyte solution 202*a,b* may be at least partially disposed between at least two layers of air breathing cathodes 201*a,b* (e.g., oxygenated mesh, polymer mesh, carbon paper, porous carbon, porous polymer, etc.). The air breathing cathodes 201*a,b* may be at least partially enclosed by a flexible, permeable membrane that prevents liquid or other undesirable contaminants (e.g., water, carbon dioxide, air pollutants, etc.) from reaching the air breathing cathodes 201*a,b*. In some implementations, the zinc anode 200 may be manually rechargeable via replacement of the zinc anode 200 by the user. In some implementations, the vaporizer 100 and metal-air battery 212 may be disposable. In some situations, access to power sources, such as electrical outlets or rechargeable batteries, may be limited. Thus, it is desirable to have a vaporizer 100 that can be disposed of after the power supply has been depleted. Metal-air battery 212 is more environmentally friendly and better suited to be disposed of and/or recycled in a responsible manner than traditional metal-ion (e.g. lithium-ion) batteries. Metal-air battery 212 can be produced for a fraction of the cost of traditional metal-ion batteries.

Figure 3:
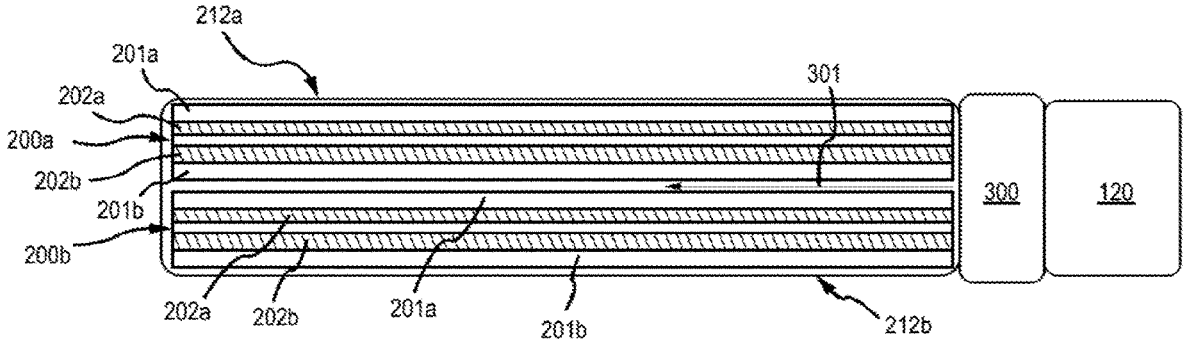
FIG. 3 illustrates a block diagram of another vaporizer consistent with implementations of the current subject matter.

Referring to the vaporizer 100 of FIG. 3, the vaporizer 100 may include more than one metal-air battery 212*a,b*. The metal-air battery 212*a,b* may be arranged in a stack, and they may be in parallel or in series within an electrical circuit. The vaporizer 100 may include an air channel 301 disposed between the metal-air battery 212*a,b*. The vaporizer 100 may include one or more zinc anodes 200*a,b*, at least partially disposed between layers of electrolyte solution 202*a,b* and further disposed at least partially between layers of air breathing cathodes 201*a,b*. The air channel 301 allows air containing about 21% oxygen to react with the air breathing cathodes 201*a,b* to form ions that travel to the zinc anodes 200*a,b*, to release electrons thus producing electrical power. In some implementations, the output of the metal-air battery may be proportional to the intensity of a user's puff or draw, such that a user may be able to control the amount of aerosol received via the intensity of their puff or draw. The vaporizer 100 may, additionally or alternatively, include an air pump 300. The air pump 300 may be at least partially disposed between the vaporizer body and the cartridge receptacle containing the vaporizer cartridge 120. By increasing the amount and the rate of air provided through air channel 301 to the air breathing cathodes 201*a,b*, the reaction rate within the metal-air battery 212*a,b* can be increase to provide more power than ordinary metal-air batteries. In this manner, metal-air battery 212*a,b* can achieve temporary electrical discharges rates comparable with traditional metal-ion batteries. When vaporizer 100 is not in use, the air provide through the through air channel 301 can be reduced to slow the reaction and conserve power. Additionally, the vaporizer 100 may include a switch (not shown) which closes a circuit that includes the controller 104 (e.g., a printed circuit board, a microcontroller, or the like), the power source, and the heating element, when the switch is in the ON position. The switch may be any suitable switch configuration including without limitation: a press switch, a slide switch, a toggle switch, a capacitive switch, a momentary switch, a solenoid, a relay, and/or a solid-state switch. The switch may form a part of the vaporizer body. The switch may form a part of the vaporizer cartridge 120. The switch may form a part of the air pump 300.

The air pump 300 may form a part of the vaporizer body. The air pump 300 may form a part of the vaporizer cartridge 120. The air pump 300 may be perforated to allow air to flow through while also preventing liquid passage. The air pump 300 may be flexible, such that a user could manually compress the air pump 300. The air pump 300 may be a flexible bladder, a pressurizable tank, a mechanical pump, an electrical pump, or other suitable configurations. Activation of the air pump 300 may provide additional air to the metal-air battery 212*a,b*, thereby accelerating the reaction and increasing the output of the metal-air battery 212*a,b*. Additionally or alternatively, the body of the vaporizer 100 may be stainless steel, plastic, or other materials that may withstand corrosive properties of electrolyte solution 202*a, b*. Additionally or alternatively, the body of the vaporizer 100 may include a valve (not shown) at the end opposite the user and vaporizer cartridge 120 which may open during use to allow additional air to reach the metal-air battery 212*a,b* by selectively passing air through the air channel 301 to the cathodes 201*a,b*. For example, the valve may be opened by a user's puff or draw, or the valve may button operated. The air pump 300 may be configured to selectively operate only when increased power is required, e.g. when a user draws on the device. Additionally or alternatively, the air pump 300 may be configured to provide an adjustable airflow output to deliver more or less air to the metal-air battery 212*a,b*. This adjustable or selective airflow output may be achieved via any suitable method, including without limitation mechanical adjustment or selection, electrical adjustment or selection, etc.

In alternative configurations, the vaporizer includes a vaporizer body having a cartridge coupler configured to couple a cartridge. The vaporizer includes each of the aforementioned features, except that instead of a cartridge receptacle for receiving the cartridge, the vaporizer has a cartridge coupler for coupling to the cartridge. For example, the cartridge coupler can be a part of the vaporizer body that is integrated into the vaporizer body or forms a portion of the vaporizer body. Alternatively, the cartridge coupler can be a separate piece that is attached to the vaporizer body, either permanently or releasably. In some embodiments, the cartridge coupler can be attached to the vaporizer body via snap-fit, friction-fit, magnetic, thread, or other suitable attachment means in either a temporary or permanent fashion. The cartridge coupler can in turn attached to the cartridge via snap-fit, friction-fit, magnetic, thread, or other suitable attachment means in either a temporary or permanent fashion. For example, the cartridge coupler can be secured to the vaporizer body, such that a cartridge can be coupled to and removed from the cartridge coupler without detaching the cartridge coupler from the vaporizer body.

In alternative configurations, the vaporizer includes a vaporizer body having a storage compartment configured to receive a vaporizable material. The vaporizer includes each of the aforementioned features, except that a cartridge receptacle or a cartridge coupler is not required. In these configurations, there is no need for a separate cartridge, cartridge receptacle, or cartridge coupler since the storage compartment is integrated into the vaporizer. For example, liquid or non-liquid vaporizable material can be added directly into the storage compartment contained in the vaporizer body. The storage compartment can deliver the vaporizable material to, or place in thermal contact with, a resistive heating element or other heater configuration, such that vaporizable material is vaporized after exiting the storage compartment.

Terminology

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the teachings herein. For example, the order in which various described method steps are performed may often be changed in alternative embodiments, and in other alternative embodiments, one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A vaporizer body, the vaporizer body comprising:

a first metal-air battery and a second metal-air battery;

an air channel disposed in the vaporizer body, the air channel configured to provide air to the first metal-air battery; and an air pump proximate the air channel and the first metal-air battery, the air pump configured to selectively provide air through the air channel to the first metal-air battery, wherein the air channel is disposed between a first cathode of the first metal-air battery and a second cathode of the second metal-air battery.

2. The vaporizer body of claim 1, further comprising a cartridge receptacle configured to receive a cartridge including a vaporizable material.

3. The vaporizer body of claim 1, wherein the air channel is configured to provide air to the first cathode of the first metal-air battery.

4. The vaporizer body of claim 1, wherein the air pump is configured to selectively provide air through the air channel to the first cathode of the first metal-air battery.

5. The vaporizer body of claim 1, wherein the vaporizer body has a first end and a second end, wherein the first end is opposite to the second end, and wherein the first end is free of electrical contacts.

6. The vaporizer body of claim 5, further comprising a cartridge receptacle, wherein the cartridge receptacle is disposed at the second end.

7. The vaporizer body of claim 5, further comprising a cartridge receptacle, wherein a base of the cartridge receptacle includes one or more electrical contacts configured to transmit an electrical power to the cartridge.

8. The vaporizer body of claim 7, wherein the air channel extends from the base of the cartridge receptacle.

9. The vaporizer body of claim 5, wherein the air channel extends to the first end of the vaporizer body.

10. The vaporizer body of claim 5, wherein the air channel extends along a length of the first cathode of the first metal-air battery, the second cathode of the second metal-air battery, or both.

11. The vaporizer body of claim 1, wherein an anode of the first metal-air battery comprises a metallic powder or a metal alloy.

12. The vaporizer body of claim 1, wherein the first cathode of the first metal-air battery comprises a porous carbon.

13. The vaporizer body of claim 1, wherein an electrolyte of the first metal-air battery comprises potassium hydroxide.

14. The vaporizer body of claim 1, wherein an electrolyte of the first metal-air battery includes an additive.

15. The vaporizer body of claim 1, wherein the first metal-air battery further comprises a selectively permeable membrane, wherein the selectively permeable membrane is disposed on the first cathode of the first metal-air battery or the selectively permeable membrane forms a portion of the air channel.

16. The vaporizer body of claim 15, wherein the selectively permeable membrane is permeable to oxygen and/or air.

17. The vaporizer body of claim 15, wherein the selectively permeable membrane is impermeable to water and/or carbon dioxide.

18. The vaporizer body of claim 1, wherein the air pump comprises a flexible bladder, a pressurizable tank, a mechanical pump, an electrical pump, or a combination thereof.

19. The vaporizer body of claim 1, further comprising:

a selectively permeable membrane, wherein the selectively permeable membrane is disposed between the air channel, and at least one of the first cathode and the second cathode.

20. A vaporizer comprising:

a vaporizer body comprising:

a first metal-air battery and a second metal-air battery;

an air channel disposed in the vaporizer body, the air channel configured to provide air to the first metal-air battery; and an air pump proximate the air channel and the first metal-air battery, the air pump configured to selectively provide air through the air channel to the first metal-air battery, wherein the air channel is disposed between a first cathode of the first metal-air battery and a second cathode of the second metal-air battery.

* * * * *